US008466362B2

(12) United States Patent
Hsiao

(10) Patent No.: US 8,466,362 B2
(45) Date of Patent: Jun. 18, 2013

(54) DUAL ROTOR AXIAL-FLOW ROTOR VALVE STRUCTURE

(76) Inventor: Kuo-Ming Hsiao, Taoyuan County (TW)

( * ) Notice: Subject to any disclaimer, the term of this patent is extended or adjusted under 35 U.S.C. 154(b) by 0 days.

(21) Appl. No.: 13/334,126

(22) Filed: Dec. 22, 2011

(65) Prior Publication Data

US 2012/0291609 A1 Nov. 22, 2012

(30) Foreign Application Priority Data

May 17, 2011 (TW) ..... 100117192 A

(51) Int. Cl.
*G10D 9/04* (2006.01)

(52) U.S. Cl.
USPC ..... 84/390; 84/395; 984/144

(58) Field of Classification Search
USPC ..... 84/390, 395; 984/144
See application file for complete search history.

(56) References Cited

U.S. PATENT DOCUMENTS

| | | | | | |
|---|---|---|---|---|---|
| 12,628 | A * | 4/1855 | Hammer | 84/390 |
| 143,134 | A * | 9/1873 | Fiske | 84/390 |
| 179,372 | A * | 6/1876 | Tischendorf | 84/390 |
| 462,148 | A * | 10/1891 | Mankey et al. | 84/390 |
| 1,703,411 | A * | 2/1929 | Steinmetz | 84/390 |
| 2,484,408 | A * | 10/1949 | Hubley | 84/390 |
| 3,631,755 | A * | 1/1972 | Glantz et al. | 84/388 |
| 3,937,116 | A * | 2/1976 | Ramirez | 84/395 |
| 4,047,459 | A * | 9/1977 | Nakamura | 84/390 |
| 4,112,806 | A * | 9/1978 | Thayer | 84/390 |
| 4,299,156 | A * | 11/1981 | Thayer | 84/390 |
| 4,336,738 | A * | 6/1982 | Alexander | 84/390 |
| 5,365,823 | A * | 11/1994 | Leonard | 84/395 |
| 5,900,563 | A * | 5/1999 | Leonard | 84/390 |
| 8,138,405 | B2 * | 3/2012 | Hsiao | 84/396 |
| 2012/0291609 | A1 * | 11/2012 | Hsiao | 84/390 |

OTHER PUBLICATIONS

Getzen 3062 Trombone, viewed Feb. 1, 2013 at http://getzen.com/trombone/custombass/3062af-p.shtml.*

Trombone Review, Getzen 3062AF, review entered Aug. 9, 2006, viewed Feb. 1, 2013 at http://tromboneforum.org/index.php?topic=27285.0.*

* cited by examiner

*Primary Examiner* — David Warren
*Assistant Examiner* — Robert W Horn
(74) *Attorney, Agent, or Firm* — Rosenberg, Klein & Lee

(57) ABSTRACT

A dual rotor axial-flow rotor valve structure includes a rotor valve seat for rotatably receiving rotatable first and second rotor valves. The rotor valve seat has a first and a second extension sections connected to end sections of a second and a first tuning slide assembly s. The first rotor valve communicates with end sections of first and second flow passages with a mouthpiece and the other end of the second tuning slide assembly and communicate the other end of the second flow passage with the first or second extension section. The second rotor valve communicates ends of the first and second flow passages with the other end of the first tuning slide assembly and a main tuning slide assembly and communicate the other end of the second flow passage with the first or second extension section.

20 Claims, 4 Drawing Sheets

DUAL ROTOR AXIAL-FLOW ROTOR VALVE STRUCTURE

BACKGROUND OF THE INVENTION

1. Field of the Invention

The present invention relates generally to a dual rotor axial-flow rotor valve structure, and more particularly to a dual rotor axial-flow rotor valve structure, which has smaller volume and is convenient to operate.

2. Description of the Related Art

Following the raise of people's music appreciation level, performers have been more and more required to improve their performance skill to satisfy the audiences. On the other hand, the improvements of the structures of the musical instruments help in promoting the skills of the performers.

FIG. 1 shows a musical instrument C (bass trombone) with two tuning slide, assemblies. The musical instrument C mainly includes a main tuning slide assembly 5, a slide tube 50, a first tuning slide assembly 51, a second tuning slide assembly 52, a first rotor valve 53 and a second rotor valve 54. One end of the main tuning slide assembly 5 is a trumpet-shaped end 55. The other end of the main tuning slide assembly 5 is connected to the slide tube 50 and the first and second tuning slide assemblies 51, 52 via the first and second rotor valves 53, 54 respectively. A mouthpiece 501 is disposed at the other end of the slide tube 50. The first and second rotor valves 53, 54 are respectively connected with a first shift rod 531 and a second shift rod 541, which extend outward. In operation, via the first and second shift rods 531, 541, the first and second rotor valves 53, 54 are driven to change the communication relationships between the slide tube 50 and the first and second tuning slide assemblies 51, 52 and the main tuning slide assembly 5 to form different resonance lengths. For example, in the case that the first and second rotor valves 53, 54 are such positioned that the slide tube 50 directly communicates with the main tuning slide assembly 5, the musical instrument will have a shortest resonance length. In the case that the first and second rotor valves 53, 54 are such positioned that the slide tube 50 communicates with the main tuning slide assembly 5 through the first tuning slide assembly 51 or second tuning slide assembly 52, the musical instrument will have a longer resonance length. In the case that the first and second rotor valves 53, 54 are such positioned that the slide tube 50 communicates with the main tuning slide assembly 5 through both the first and second tuning slide assemblies 51, 52, the musical instrument will have a longest resonance length. Accordingly, the musical instrument can have different tunes to achieve different performance effects. However, in practice, the above structure has the following shortcomings:

1. The first and second rotor valves 53, 54 are respectively disposed between the main tuning slide assembly 5, the slide tube 50 and the first and second tuning slide assemblies 51, 52. Therefore, a larger space is occupied. This complicates the loop design of the musical instrument C and increases the development cost of the product. Also, this may affect the sound quality.
2. The first and second rotor valves 53, 54 are separately arranged with each other through a tube to achieve different connection and communication relationships between the loops. As a result, the number of the components is increased to increase the manufacturing cost. Moreover, the structure of the musical instrument C as a whole is complicated. Also, the manufacturing process is more complicated. This is not propitious for the promotion of competitiveness of the product.

3. The musical instrument C has a first rotor valve 53 and a second rotor valve 54 that are independent from each other. Therefore, in maintenance, it is necessary to disassemble the first and second rotor valves 53, 54 one by one. Also, after the maintenance, it is necessary assemble, the first and second rotor valves 53, 54 one by one. This causes inconvenience in use of the musical instrument C.

SUMMARY OF THE INVENTION

It is therefore a primary object of the present invention to provide a dual rotor axial-flow rotor valve structure, which is easy to operate for quickly tuning a musical instrument.

It is a further object of the present invention to provide the above dual rotor axial-flow rotor valve structure, which has a volume smaller than that of a conventional rotor valve structure and a weight lighter than that of the conventional rotor valve structure. Accordingly, the relevant musical instrument can be simplified and lightened in design.

To achieve the above and other objects, the dual rotor axial-flow rotor valve structure of the present invention includes: a rotor valve seat having a receiving space, the receiving space having a first opening and a second opening opposite to the first opening, the first and second openings communicating with external side, a first extension section and a second extension section being disposed on a circumference of the rotor valve seat in communication with the receiving space, the first and second extension sections being respectively connected to an end section of a second tuning slide assembly of a musical instrument and an end section of a first tuning slide assembly of the musical instrument; a first rotor valve pivotally rotatably disposed in the receiving space of the rotor valve seat on one side proximal to the first opening, a first flow passage and a second flow passage being independently disposed on the first rotor valve, one end section of the first flow passage and one end section of the second flow passage being formed on one side of the first rotor valve, which side is directed to the first opening, the first rotor valve being pivotally rotatable to communicate the first and second flow passages with a mouthpiece of the musical instrument and the other end of the second tuning slide assembly and communicate the other end of the second flow passage with one of the first and second extension sections of the rotor valve seat; and a second rotor valve pivotally rotatably disposed in the receiving space of the rotor valve seat on one side proximal to the second opening, a first flow passage and a second flow passage being independently disposed on the second rotor valve, one end section of the first flow passage and one end section of the second flow passage being formed on one side of the first rotor valve, which side is directed to the second opening, the first flow passage of the second rotor valve communicating with the first flow passage of the first rotor valve, the second rotor valve being pivotally rotatable to communicate the first and second flow passages with a main tuning slide assembly of the musical instrument and the other end of the first tuning slide assembly and communicate the other end of the second flow passage with one of the first and second extension sections of the rotor valve seat.

In the above dual rotor axial-flow rotor valve structure, a first outer cover and a second outer cover are respectively capped on the first and second openings of the rotor valve seat. The first outer cover is formed with a first insertion aperture and a second insertion aperture for respectively receiving an extension section of the mouthpiece of the musical instrument and the other end section of the second tuning slide assembly of the musical instrument. The second outer cover is formed with a first insertion aperture and a second insertion aperture for respectively receiving an end section of the main tuning slide assembly of the musical instrument and the other end section of the first tuning slide assembly of the musical instrument.

In the above dual rotor axial-flow rotor valve structure, at least one locating recess is disposed on an inner circumference of each of the first and second openings of the rotor valve seat. The first and second outer covers are respectively formed with locating protrusions corresponding to the locating recesses, whereby the locating protrusions can be inlaid in the locating recesses.

In the above dual rotor axial-flow rotor valve structure, each of the first and second rotor valves has a drive shaft. The drive shafts of the first and second rotor valves pass through the first and second outer covers to couple with a first shift rod and a second shift rod.

In the above dual rotor axial-flow rotor valve structure, a retainer ring is connected to each of the first and second openings of the rotor valve seat. An annular flange is formed on inner circumference of each retainer ring. The annular flanges serve to abut against the first and second outer covers to fix the first and second outer covers.

In the above dual rotor axial-flow rotor valve structure, an outer thread is formed on an outer circumference of each of the first and second openings of the rotor valve seat and an inner thread is formed on the inner circumference of each retainer ring for screwing on the outer thread.

In the above dual rotor axial-flow rotor valve structure, an airtight sealing ring is disposed at a junction section between the first flow passage of the first rotor valve and the second flow passage of the second rotor valve.

The present invention can be best understood through the following description and accompanying drawings, wherein:

DETAILED DESCRIPTION OF THE PREFERRED EMBODIMENT

Figure 1:
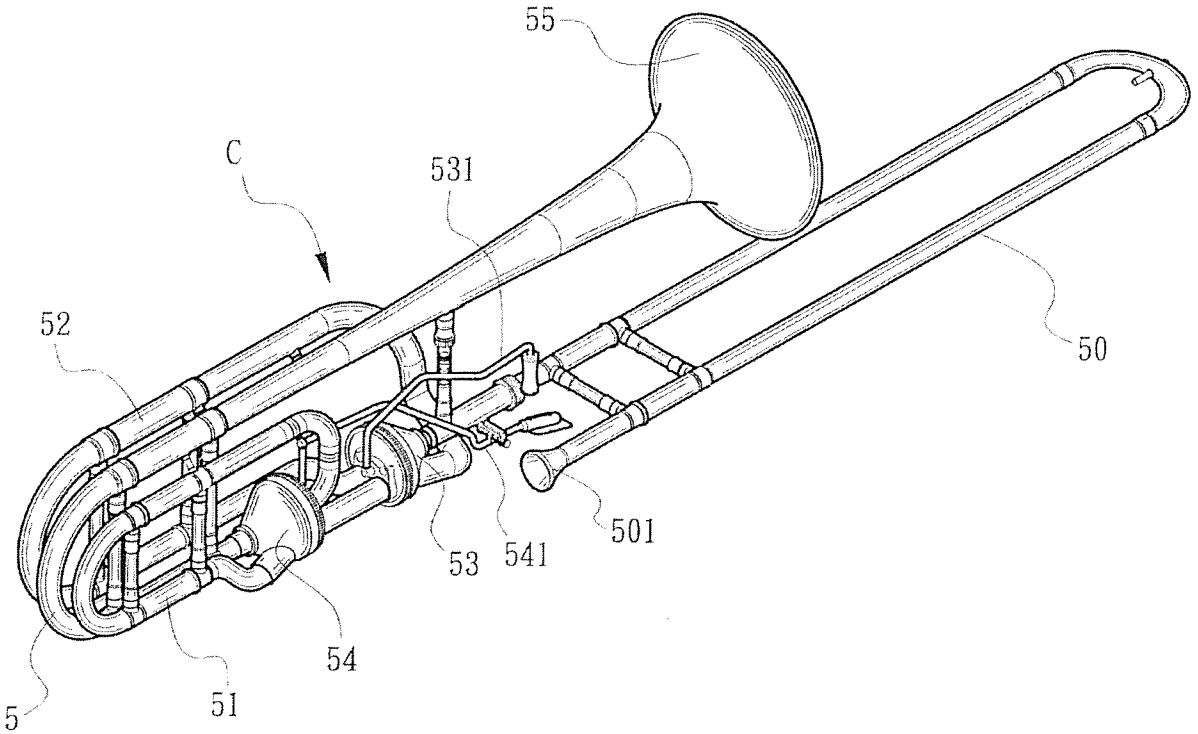
Fig. 1 PRIOR ART
FIG. 1 is a perspective view of a conventional brass wind with two tuning slide assemblies.
Figure 2:
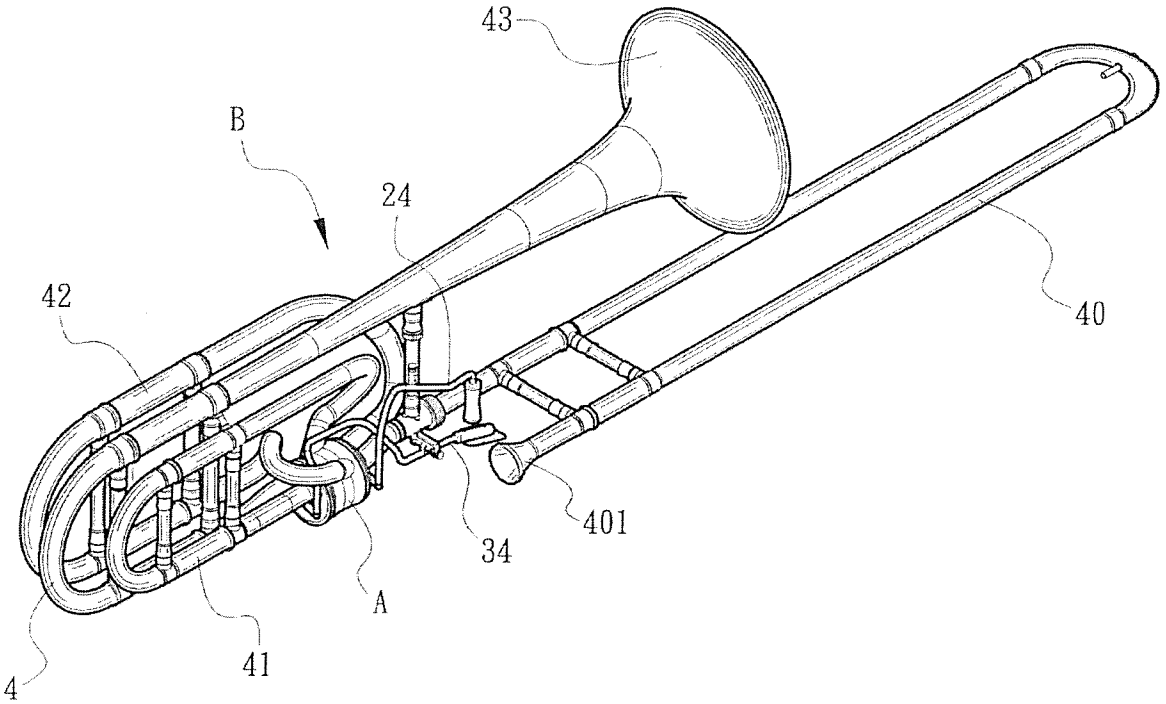
FIG. 2 is a perspective view showing that the present invention is applied to a brass wind with two tuning slide assemblies.
Figure 3:
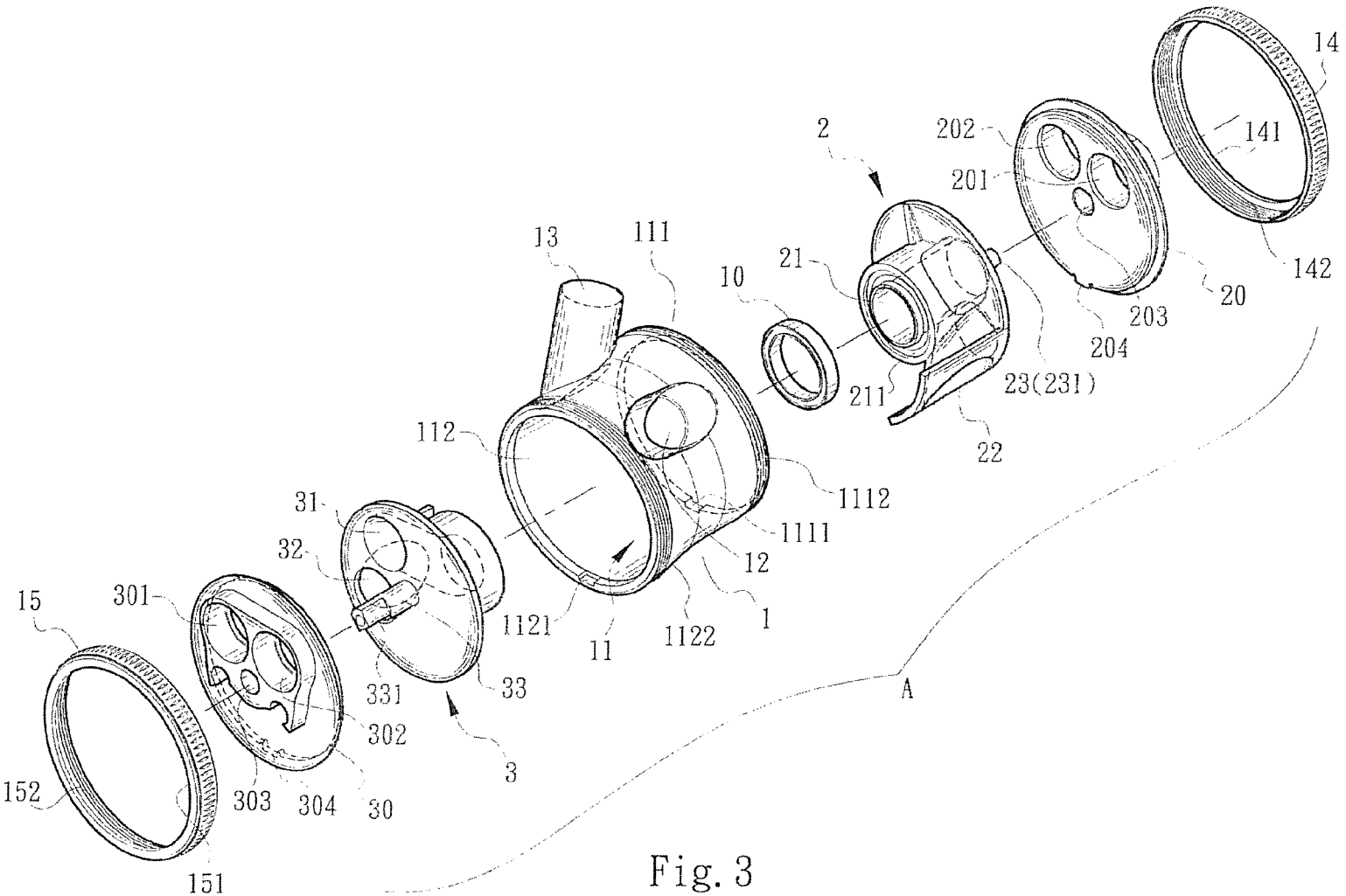
FIG. 3 is a perspective exploded view of the present invention.
Figure 5:
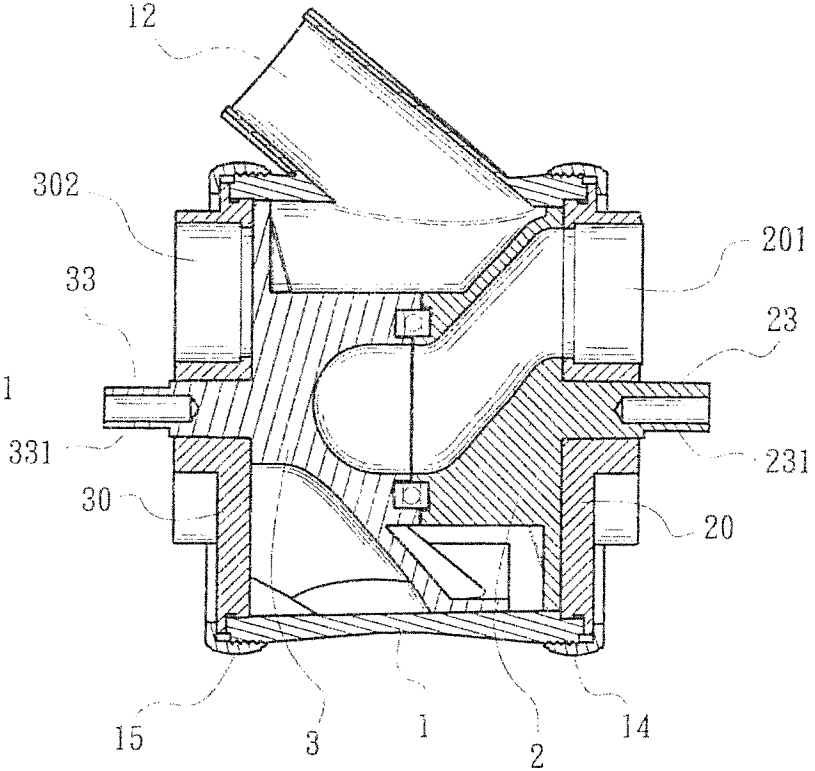
FIG. 5 is a sectional assembled view of the present invention.
Figure 4:
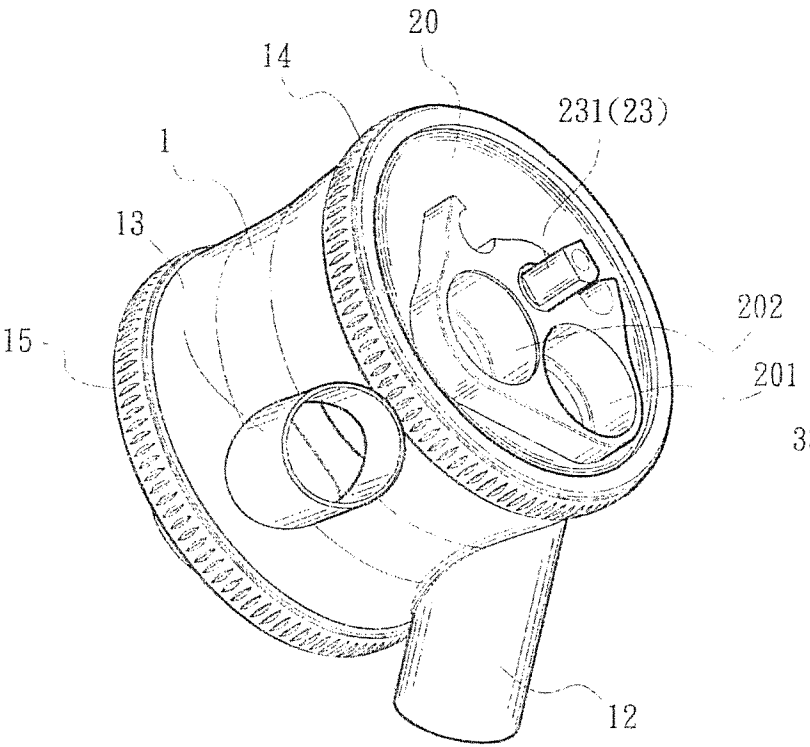
FIG. 4 is a sectional assembled view of the present invention.

Please refer to FIGS. 2 to 5. The dual rotor axial-flow rotor valve structure of the present invention has a rotor valve main body A including a rotor valve seat 1, a first rotor valve 2, a first outer cover 20, a second rotor valve 3 and a second outer cover 30. The rotor valve seat 1 has an internal receiving space 11 having a first opening 111 and a second opening 112 opposite to the first opening 111. The first and second openings 111, 112 communicate with external side. A locating recess 1111, 121 is formed on an inner circumference of each of the first and second openings 111, 112. An outer thread 1112, 1122 is formed on an outer circumference of each of the first and second openings 111, 112. A first extension section 12 and a second extension section 13 are disposed on the circumference of the rotor valve seat 1 in communication with the receiving space 11. The first and second extension sections 12, 13 are respectively connected to the end sections of second and first tuning slide assemblies 42, 41 of a musical instrument B, (which can be a bass trombone). The first and second rotor valves 2, 3 are pivotally rotatably disposed in the first and second openings 111, 112 of the rotor valve seat 1 respectively. The first and second rotor valves 2, 3 are respectively formed with two first flow passages 21, 31 and two second flow passages 22, 32 that are independent from each other. One end section of the first flow passage 21 and one end section of the second flow passage 22 are coplanarly formed on one side of the first rotor valve 2, which side is directed to the first opening 111. An outward protruding drive shaft 23 is disposed at a center of the side of the first rotor valve 2. A coupling section 231, (which can be a plane cut face), is disposed on the drive shaft 23 for coupling with an external first shift rod 24. An annular groove 211 is formed on an end face of the other end section of the first flow passage 21 for receiving an airtight sealing ring 10. The other end section of the second flow passage 22 is formed on a lateral face of the first rotor valve 2 corresponding to the first and second extension sections 12, 13 of the rotor valve seat 1. One end section of the first flow passage 31 and one end section of the second flow passage 32 are coplanarly formed on one side of the second rotor valve 3, which side is directed to the second opening 112. An outward protruding drive shaft 33 is disposed at a center of the side of the second rotor valve 3. A coupling section 331, (which can be a plane cut face), is disposed on the drive shaft 33 for coupling with an external second shift rod 34. The other end section of the first flow passage 31 communicates with the first flow passage 21 via the airtight sealing ring 10. The other end section of the second flow passage 32 is formed on a lateral face of the second rotor valve 3 corresponding to the first and second extension sections 12, 13 of the rotor valve seat 1. The first and second outer covers 20, 30 are respectively capped on the first and second openings 111, 112 of the rotor valve seat to block the first and second openings 111, 112. Locating protrusions 204, 304 are respectively formed on the circumferences of the first and second outer covers 20, 30. The locating protrusions 204, 304 can be inlaid in the locating recesses 1111, 1121 of the first and second openings 111, 112 to locate the first and second outer covers 20, 30 on the rotor valve seat 1. Retainer rings 14, are respectively disposed around the first and second outer covers 20, 30. Inner threads 142, 152 are formed on inner circumferences of the retainer rings 14, 15 for screwing on the outer threads 1112, 1122. In addition, annular flanges 141, 151 are respectively formed on the inner circumferences of the retainer rings 14, 15 for preventing the first and second outer covers 20, and the first and second rotor valves 2, 3 from detaching from the rotor valve seat 1. The first outer cover 20 is formed with a shaft hole 203 corresponding to the drive shaft 23 and first and second insertion apertures 201, 202 corresponding to the first and second flow passages 21, 22 of the first rotor valve 2 respectively. One end section of the slide tube 40 of the musical instrument B can be plugged into the first insertion aperture 201 into communication therewith. (The other end section of the slide tube 40 is connected with a mouthpiece 401). The other end section of the second tuning slide assembly 42 of the musical instrument B can be plugged into the second insertion aperture 202 into communication therewith. The second outer cover 30 is formed with a shaft hole 303 corresponding to the drive shaft 33 and first and second insertion apertures 301, 302 corresponding to the first and second flow passages 31, 32 of the second rotor valve 3 respectively. One end section of the main tuning slide assembly 4 of the musical instrument B can be plugged into the first insertion aperture 301 into communication therewith. (The other end section of the main tuning slide assembly 4 is a trumpet-shaped opening 43). The other end section of the first tuning slide assembly 41 of the musical instrument B can be plugged into the second insertion aperture 302 into communication therewith.

According to the above arrangement, in operation, when the first flow passage 21 of the first rotor valve 2 is aligned with the first insertion aperture 201 of the first outer cover 20 and the first flow passage 31 of the second rotor valve 3 is aligned with the first insertion aperture 301 of the second outer cover 30, the sound emitted from the mouthpiece 401 can go through the slide tube 40 and directly pass through the main tuning slide assembly 4 in a shortest path (resonance length) to spread out from the trumpet-shaped opening 43. In the case that the first rotor valve 2 is driven by the first shift rod 24 to pivotally rotate and make the second flow passage 22 aligned with the first insertion aperture 201 of the first outer cover 20 and make the first flow passage 21 aligned with the second insertion aperture 202 (with the second rotor valve 3 kept unmoved), then the sound of the slide tube 40 will first go through the second tuning slide assembly 42 and then through the main tuning slide assembly 4 to spread out from the trumpet-shaped opening 43. On the other hand, in the case that the first rotor valve 2 is kept unmoved and the second rotor valve 3 is driven by the second shift rod 34 to pivotally rotate and make the second flow passage 32 aligned with the first insertion aperture 301 of the second outer cover 30 and make the first flow passage 31 aligned with the second insertion aperture 302, then the sound of the slide tube 40 will first go through the first tuning slide assembly 41 and then through the main tuning slide assembly 4 to spread out from the trumpet-shaped opening 43. In the case that the first rotor valve 2 is driven by the first shift rod 2L to pivotally rotate and make the second flow passage 22 aligned with the first insertion aperture 201 of the first outer cover 20 and the second rotor valve 3 is driven by the second shift rod 34 to pivotally rotate and make the second flow passage 32 aligned with the first insertion aperture 301 of the second outer cover 30 and make the first flow passage 31 aligned with the second insertion aperture 302, then the sound of the slide tube 40 will first go through the second tuning slide assembly 42 and then through the first tuning slide assembly 41 and then through the main tuning slide assembly 4 in a longest path (resonance length) to spread out from the trumpet-shaped opening 43. By means of the above structure, the musical instrument B can be tuned.

In conclusion, the dual rotor axial-flow rotor valve structure of the present invention has smaller volume and is convenient to operate.

The above embodiment is only used to illustrate the present invention, not intended to limit the scope thereof. Many modifications of the above embodiment can be made without departing from the spirit of the present invention.

What is claimed is:

1. A dual rotor axial-flow rotor valve structure comprising:

a rotor valve seat having a receiving space, the receiving space having a first opening and a second opening opposite to the first opening, the first and second openings communicating with external side, a first extension section and a second extension section being disposed on a circumference of the rotor valve seat in communication with the receiving space;

a first rotor valve pivotally rotatably disposed in the receiving space of the rotor valve seat on one side proximal to the first opening, a first flow passage and a second flow passage being independently disposed on the first rotor valve, one end section of the first flow passage and one end section of the second flow passage being formed on one side of the first rotor valve, which side is directed to the first opening, the other end section of the second flow passage being directed to inner circumference of the rotor valve seat, whereby the first rotor valve can be pivotally rotated to selectively communicate the second flow passage with one of the first and second extension sections; and a second rotor valve pivotally rotatably disposed in the receiving space of the rotor valve seat on one side proximal to the second opening, a first flow passage and a second flow passage being independently disposed on the second rotor valve, one end section of the first flow passage and one end section of the second flow passage being formed on one side of the first rotor valve, which side is directed to the second opening, the first flow passage of the second rotor valve communicating with the first flow passage of the first rotor valve, the other end section of the second flow passage of the second rotor valve being directed to the inner circumference of the rotor valve seat, whereby the second rotor valve can be pivotally rotated to selectively communicate the second flow passage with one of the first and second extension sections.

2. The dual rotor axial-flow rotor valve structure as claimed in claim 1, wherein a first outer cover and a second outer cover are respectively capped on the first and second openings of the rotor valve seat, the first outer cover being formed with a first insertion aperture and a second insertion aperture for respectively receiving an extension section of a mouthpiece of a musical instrument and an end section of a second tuning slide assembly of the musical instrument, the second outer cover being formed with a first insertion aperture and a second insertion aperture for respectively receiving an end section of a main tuning slide assembly of the musical instrument and an end section of a first tuning slide assembly of the musical instrument, the first and second extension sections being respectively connected to the other end section of the second tuning slide assembly of the musical instrument and the other end section of the first tuning slide assembly of the musical instrument.

3. The dual rotor axial-flow rotor valve structure as claimed in claim 2, wherein at least one locating recess is disposed on an inner circumference of each of the first and second openings of the rotor valve seat, the first and second outer covers being respectively formed with locating protrusions corresponding to the locating recesses, whereby the locating protrusions can be inlaid in the locating recesses.

4. The dual rotor axial-flow rotor valve structure as claimed in claim 2, wherein each of the first and second rotor valves has a drive shaft, the drive shafts of the first and second rotor valves passing through the first and second outer covers to couple with a first shift rod and a second shift rod.

5. The dual rotor axial-flow rotor valve structure as claimed in claim 2, wherein a retainer ring is connected to each of the first and second openings of the rotor valve seat, an annular flange being formed on inner circumference of each retainer ring, the annular flanges serving to abut against the first and second outer covers to fix the first and second outer covers.

6. The dual rotor axial-flow rotor valve structure as claimed in claim 3, wherein a retainer ring is connected to each of the first and second openings of the rotor valve seat, an annular flange being formed on inner circumference of each retainer ring, the annular flanges serving to abut against the first and second outer covers to fix the first and second outer covers.

7. The dual rotor axial-flow rotor valve structure as claimed in claim 4, wherein a retainer ring is connected to each of the first and second openings of the rotor valve seat, an annular flange being formed on inner circumference of each retainer ring, the annular flanges serving to abut against the first and second outer covers to fix the first and second outer covers.

8. The dual rotor axial-flow rotor valve structure as claimed in claim 5, wherein an outer thread is formed on an outer circumference of each of the first and second openings of the rotor valve seat, an inner thread being formed on the inner circumference of each retainer ring for screwing on the outer thread.

9. The dual rotor axial-flow rotor valve structure as claimed in claim 6, wherein an outer thread is formed on an outer circumference of each of the first and second openings of the rotor valve seat, an inner thread being formed on the inner circumference of each retainer ring for screwing on the outer thread.

10. The dual rotor axial-flow rotor valve structure as claimed in claim 7, wherein an outer thread is formed on an outer circumference of each of the first and second openings of the rotor valve seat, an inner thread being formed on the inner circumference of each retainer ring for screwing on the outer thread.

11. The dual rotor axial-flow rotor valve structure as claimed in claim 1, wherein an airtight sealing ring is disposed at a junction section between the first flow passage of the first rotor valve and the second flow passage of the second rotor valve.

12. The dual rotor axial-flow rotor valve structure as claimed in claim 2, wherein an airtight sealing ring is disposed at a junction section between the first flow passage of the first rotor valve and the second flow passage of the second rotor valve.

13. The dual rotor axial-flow rotor valve structure as claimed in claim 3, wherein an airtight sealing ring is disposed at a junction section between the first flow passage of the first rotor valve and the second flow passage of the second rotor valve.

14. The dual rotor axial-flow rotor valve structure as claimed in claim 4, wherein an airtight sealing ring is disposed at a junction section between the first flow passage of the first rotor valve and the second flow passage of the second rotor valve.

15. The dual rotor axial-flow rotor valve structure as claimed in claim 5, wherein an airtight sealing ring is disposed at a junction section between the first flow passage of the first rotor valve and the second flow passage of the second rotor valve.

16. The dual rotor axial-flow rotor valve structure as claimed in claim 6, wherein an airtight sealing ring is disposed at a junction section between the first flow passage of the first rotor valve and the second flow passage of the second rotor valve.

17. The dual rotor axial-flow rotor valve structure as claimed in claim 7, wherein an airtight sealing ring is disposed at a junction section between the first flow passage of the first rotor valve and the second flow passage of the second rotor valve.

18. The dual rotor axial-flow rotor valve structure as claimed in claim 8, wherein an airtight sealing ring is disposed at a junction section between the first flow passage of the first rotor valve and the second flow passage of the second rotor valve.

19. The dual rotor axial-flow rotor valve structure as claimed in claim 9, wherein an airtight sealing ring is disposed at a junction section between the first flow passage of the first rotor valve and the second flow passage of the second rotor valve.

20. The dual rotor axial-flow rotor valve structure as claimed in claim 10, wherein an airtight sealing ring is disposed at a junction section between the first flow passage of the first rotor valve and the second flow passage of the second rotor valve.

* * * * *